United States Patent [19]

Lesikar

[11] Patent Number: 4,881,280

[45] Date of Patent: Nov. 21, 1989

[54] WATERFALL PRODUCING UNIT FOR USE IN SWIMMING POOLS

[76] Inventor: Fred C. Lesikar, 641 Ryan, La Habra, Calif. 90631

[21] Appl. No.: 279,431

[22] Filed: Dec. 2, 1988

[51] Int. Cl.[4] ..... B05B 1/34; E04H 3/18

[52] U.S. Cl. ..... 4/507; 4/191; 4/591; 239/20; 239/193

[58] Field of Search ..... 4/191, 192, 506–510, 4/591; 239/20, 193

[56] References Cited

U.S. PATENT DOCUMENTS

| | | | |
|---|---|---|---|
| 2,225,836 | 12/1940 | Lund | 239/193 X |
| 4,334,328 | 6/1982 | Delepine | 4/191 |
| 4,355,762 | 10/1982 | Coleman | 239/193 |
| 4,396,508 | 8/1983 | Broughton | 210/187 |
| 4,399,742 | 8/1983 | Dobias | 98/115 SB |
| 4,404,173 | 9/1983 | Bailey et al. | 422/257 |

FOREIGN PATENT DOCUMENTS

| | | | |
|---|---|---|---|
| 275084 | 7/1988 | European Pat. Off. | 4/191 |

*Primary Examiner*—Henry J. Recla
*Assistant Examiner*—Robert M. Fetsuga
*Attorney, Agent, or Firm*—Edgar W. Averill, Jr.

[57] ABSTRACT

A unit for producing a waterfall at the edge of a swimming pool, spa or the like. The unit is mounted in the side of the pool and produces a smooth sheet of water which is directed away from the side of the pool. The unit has a baffle in the interior thereof for directing the water evenly out through the throat of the unit.

14 Claims, 2 Drawing Sheets

FIG. 1.
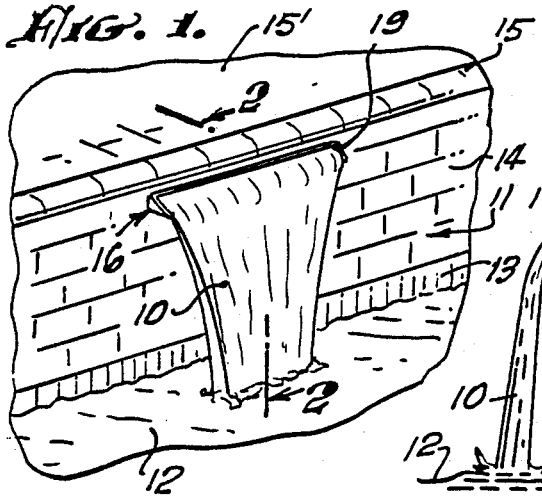
FIG. 2.
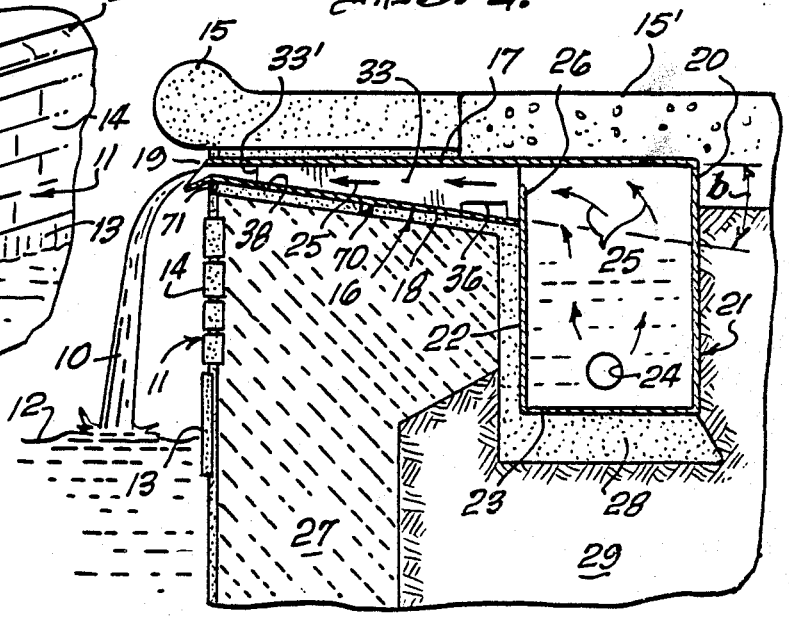
FIG. 3.
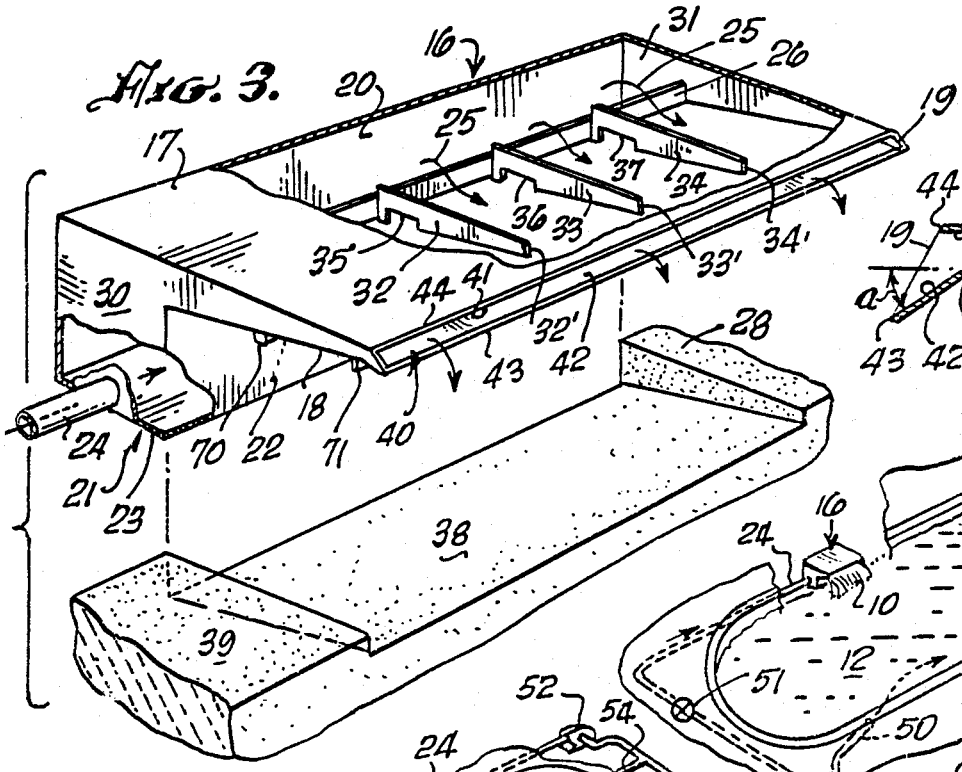
FIG. 4.
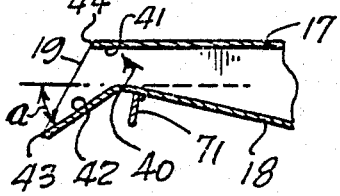
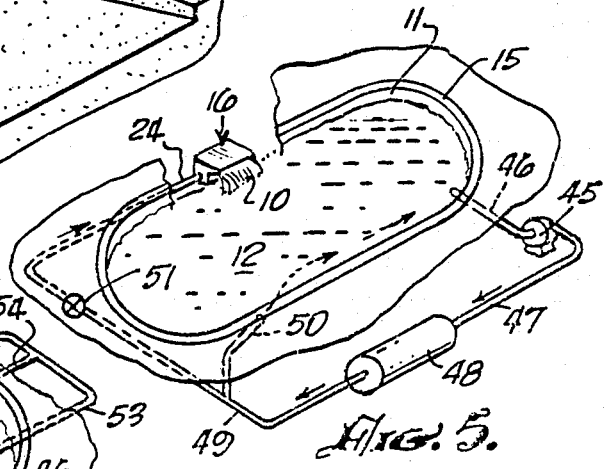
FIG. 5.
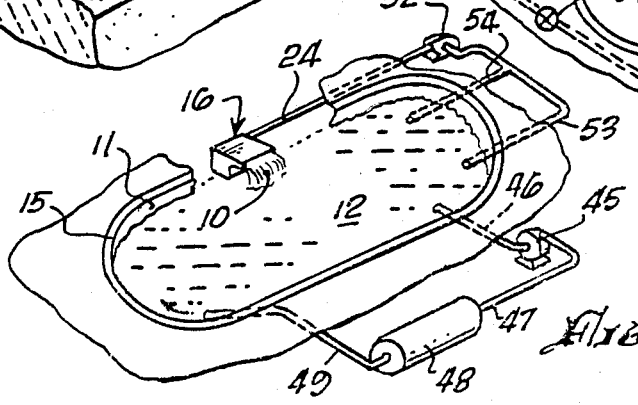
FIG. 6.

FIG. 7.
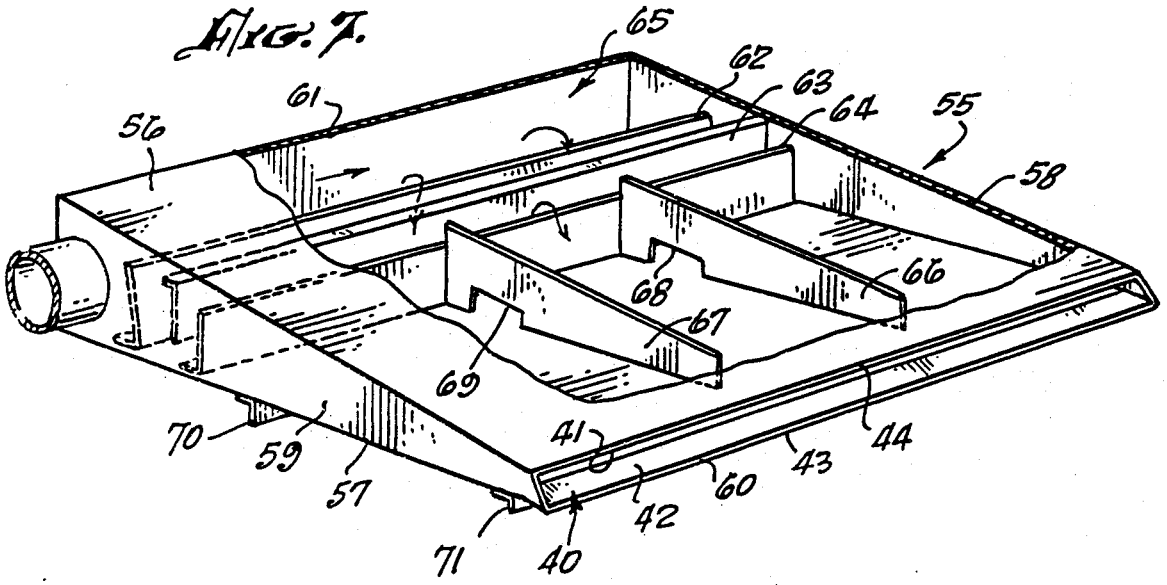
FIG. 8.
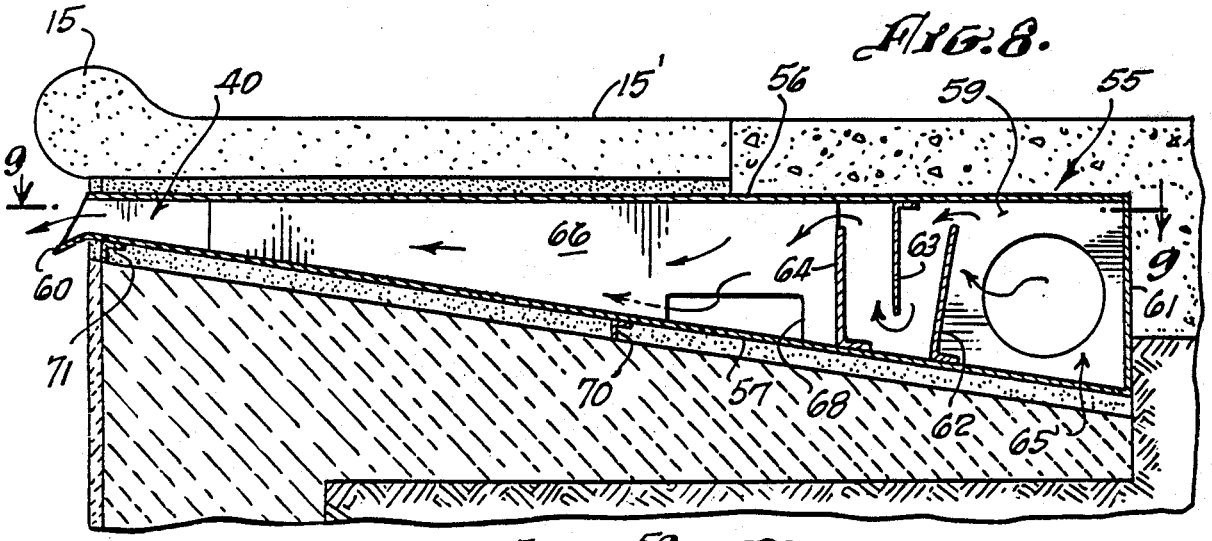
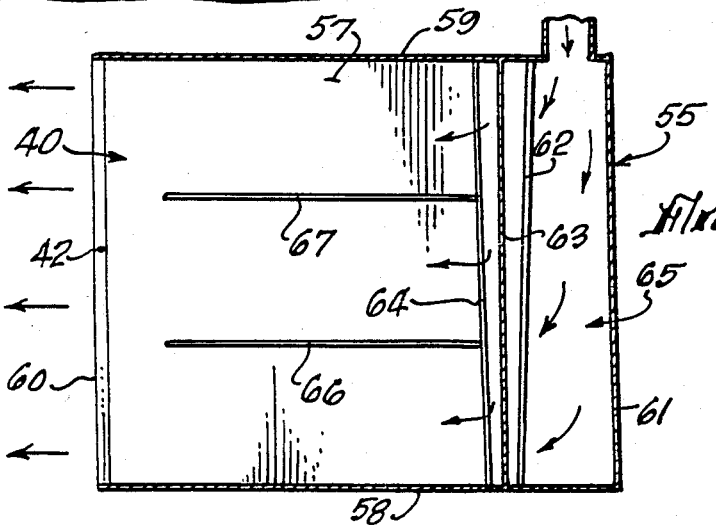
FIG. 9.

WATERFALL PRODUCING UNIT FOR USE IN SWIMMING POOLS

BACKGROUND OF THE INVENTION

The field of the invention is pools, and the invention relates more particularly to decorative accessories for swimming pools and, still further, to accessories which produce an aesthetically pleasing water flow pattern.

In order to add to the aesthetic appearance of a pool or spa, it is not uncommon to provide a waterfall at the edge of the pool and, typically, water is drawn out of the pool and passes over a weir at the edge of the pool. This approach, although aesthetically pleasing, has several shortcomings. First, the water which flows over the weir typically does not have sufficient forward movement to move away from the pool side and, thus, the area under the waterfall is typically stained with salts deposited from the water. Furthermore, the construction of such waterfalls is quite expensive since they require Gunite-formed walls including a steel inner structure and they are most commonly lined with tile or plaster. Still further, the sound of such waterfalls is typically less than desirable because the water is not propelled away from the weir.

SUMMARY OF THE INVENTION

It is an object of the present invention to provide a low-cost unit for producing a waterfall which provides a smooth sheet of water which can be propelled outwardly from the side of the pool without staining the pool side.

The present invention is for a unit for producing a waterfall at the edge of a swimming pool, spa or the like. The unit is mounted in the side of the pool and is capable of producing a smooth sheet of water which is directed away from the side of the pool. The unit has a hollow unit body mounted in the side of the pool, and the hollow unit body has a top, a bottom, a front, a back, a right side and a left side. A throat portion is located at the front of the hollow unit through which water is directed outwardly from the interior of the hollow unit body. The throat portion extends slightly past the side of the pool, and the throat portion has an upper edge and a lower edge. A manifold portion is located near the back of the unit body, and water is introduced into the manifold portion and flows through the body through the throat portion. At least one baffle is located within the hollow unit body and extends the majority of the distance between the top and the bottom thereof. The baffle extends between the right side and the left side of the body and is positioned between the manifold portion and the throat portion and nearer the manifold portion. Preferably, the unit body has its top at an angle of between about 5° and 45° with respect to the bottom and, furthermore, preferably, the lower edge of the throat extends past the upper edge and is angled downwardly at an angle of between 10° and 45° and preferably about 15° with respect to the horizontal.

BRIEF DESCRIPTION OF THE DRAWINGS

FIG. 1 is a perspective view of the side of a swimming pool with the unit for producing a waterfall mounted behind the wall.

FIG. 2 is an enlarged cross-sectional view taken along line 2—2 of FIG. 1.

FIG. 3 is an enlarged perspective view of the unit for producing a waterfall of the present invention partially cut away and also showing the Gunite portion of the side of the pool.

FIG. 4 is an enlarged cross-sectional side view of the throat of the waterfall unit of FIG. 2.

FIG. 5 is a diagrammatic view showing one piping configuration for the waterfall producing unit of the present invention.

FIG. 6 is a diagrammatic view of an alternate piping layout for the waterfall producing unit of the present invention.

FIG. 7 is a perspective view partially cut away of an alternate embodiment of the waterfall producing unit of FIG. 3.

FIG. 8 is a cross-sectional side view of the waterfall producing unit of FIG. 7 shown mounted in the side of a swimming pool.

FIG. 9 is a cross-sectional view taken along line 9—9 of FIG. 8.

DESCRIPTION OF THE PREFERRED EMBODIMENTS

A smooth waterfall 10 is shown mounted in the side 11 of a swimming pool. The pool water surface is indicated by reference character 12, and a layer of tile 13 is positioned below a decorative brick wall 14. The pool coping is indicated by reference character 15. The unit for producing a waterfall is indicated by reference character 16, and only a small portion thereof extends beyond the side 11 of the pool.

The unit is shown in side view in FIG. 2 where it can be seen that the unit has a top 17, a bottom 18, a front 19 and a back 20. A large manifold portion 21 has a front 22 and a bottom 23. A water inlet 24 is located near the bottom of the manifold 23. The general water flow direction is indicated by arrows 25, and it can be seen that the water flows over an internal baffle 26 which helps provide a smooth waterfall as indicated in FIG. 1.

Unit 16 is mounted both below the pool coping 15 and also the deck 15' so that it is almost invisible from above the pool. The pool Gunite which forms the structural side together with reinforcing bar is indicated by reference character 27. Unit 16 is set in mortar 28 which is supported by the dirt 29 which supports the pool.

The details of construction of the unit 16 are shown best in FIG. 3 where it can be seen that the water inlet 24 is welded, or otherwise connected, to the side 30 of the unit. Baffle 26 extends between sides 30 and 31 and rises from the bottom 18 of the unit. It can also be seen that there are three reinforcing ribs 32, 33 and 34 which extend between the bottom 18 and the top 17 of the unit. These reinforcing ribs have openings 35, 36 and 37 at the bottom thereof which help to equalize the water pressure between these ribs. A depression 38 is formed in Gunite 27 and permits the unit to be recessed below the top 39 of the Gunite. This depression 38 may be easily formed as the Gunite is sprayed in place. Unit 16 is set in mortar after the Gunite has already cured. By viewing the diagrammatic piping diagrams of FIGS. 4 and 5, it can be seen that the labor involved in installing the unit is minimal as compared to forming a separate pool area where the water would flow over an edge in the pool. Such separate area would require the reinforcing bar and Gunite to be formed around the area, and, also, the inner surface of the area would have to be tiled, plastered or otherwise surfaced.

Although the water enters through one of the sides of the unit, the baffle 26 combined with the manifold area 21 causes a smooth laminar flow of water at the front 19 of the unit. The reinforcing ribs 32 further enhance this laminar flow, thereby producing a very attractive, smooth waterfall 10. The front edges of the reinforcing ribs, indicated by reference characters 32', 33' and 34' should be located inwardly with respect to upper surface 41 of throat 40. A recess of about two inches has been found to eliminate any flowing of the water and assure a smooth waterfall 10 without any irregularity. These support ribs function largely to give strength between the top and bottom of the unit when the cement is placed over the top thereof for placement of the pool coping 15. Another design feature of the unit which aids in this smooth appearance is the configuration of the throat 40 which is located at the front 19 of the unit. Throat 40 has an upper surface 41 and a lower surface 42. The edge 43 of lower surface 42 extends further outwardly than does the edge 44 of upper surface 41. Furthermore, lower surface 42 is angled downwardly at an angle indicated by "a" from the horizontal. Angle "a" should be between about 10° and 45° and, preferably about 15°. This angle helps smooth the undersurface of the waterfall 10 and further directs it outwardly away from the pool side 11.

The waterfall unit of the present invention may be installed as part of the swimming pool filtering system, as shown in FIG. 5, where pump 45 has an intake 46 and an outlet 47 which leads to a filter 48. The outlet 49 of filter 48 is connected both to a return line 50 and through a valve 51 to water inlet 24 of unit 16.

An alternate piping diagram is shown in FIG. 6 where the filter outlet 49 feeds directly back into the pool in a conventional manner. A separate pump 52 has a pair of inlet lines 53 and 54 and an outlet line 24 which connects directly to unit 16. This permits further control over the volume of water flowing through unit 16 since it is not affected by the cleanliness of filter 48 nor the amount of water drawn through intake 46. It is, of course, to be understood that FIGS. 5 and 6 are diagrammatic and that typically there are two or more intake lines, one connected to one or more skimmers, and the other typically drawing water from the bottom of the pool.

A more compact unit is shown in FIGS. 7, 8 and 9 of the drawings which eliminate the large manifold area 21. This unit is indicated generally by reference character 55 and has a top 56, a bottom 57, a first side 58, a second side 59, a front 60 and a back 61. The throat 40 has the same configuration and, thus the same reference characters are used for this as shown in FIG. 3.

Three baffles 62, 63 and 64 are placed between the manifold area 65 and the throat 40 and are positioned closer to the manifold area 65 than they are to throat 40. As shown best in FIG. 9, baffle 62 is formed at a slight angle with respect to back 61, such angle being about 5°. The wider space between back 61 and baffle 62 is at a point furthest from water inlet 24. The second baffle 63 is, likewise, not parallel to first baffle 62 and is further spaced from baffle 62 at side 59 in which water inlet 24 enters. Also, as shown in FIG. 8, the first baffle is connected to the bottom 57, and baffle 63 is connected to top 56. Baffle 64 is connected to bottom 57, thus causing the water to flow in a relatively tortuous path so that smooth laminar flow is obtained at throat 40. Baffle 63 is secured at an angle of about 15° with respect to baffle 62, and baffle 64 is also secured at the same angle with respect to baffle 62. A pair of spacing tabs 70 and 71 hold the unit at a predetermined desirable distance from the surface of depression 38. Tab 71 is a bond tab which locates the manifold unit with the front of the pool Gunite so that the top of the throat will be properly spaced with respect to the pool tile.

The reinforcing ribs 66 and 67 have openings 68 and 69, all of which have the same function as reinforcing ribs 32, 33 and 34 and openings 35, 36 and 37.

An important feature of the present invention is the slight angle between the top and bottom of the unit. This angle (indicated in FIG. 2 by reference character "b") should be between 10° and 45° and, preferably, about 15°. This angle provides an ever increasing water velocity as the water approaches the throat 40. This helps assure that the water will be projected outwardly away from the side 11 of the pool. It is also important that the throat portion 40 extends outwardly past the side 11 of the pool, as shown best in FIG. 2, to prevent water-staining of side 11.

The unit can be fabricated from 316 stainless steel or, alternatively, may be injection molded or otherwise formed from a polymer such as polyvinyl chloride. In contrast to the weir approach of prior art poolside waterfalls, the waterfall unit of the present invention permits the water to be expelled under slight pressure and thereby provides not only a clean poolside but also an increased waterfall noise as the water hits the pool surface 12. More than one waterfall unit can readily be placed along the side of a pool to further enhance the aesthetic effect.

While discreet baffles, such as baffles 62, 63 and 64, are shown in the drawings, their function may be accomplished by forming alternate V-shaped bends in top 56 and bottom 57. Thus the term, "baffle," is intended to encompass such V-shaped bends and is not limited to a separate bar affixed within the unit.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. A unit for producing a waterfall at the edge of a swimming pool, spa or the like, said unit adapted to be mounted in the side of the pool, spa or the like and being capable of producing a smooth sheet of water which is directed away from the side of the pool, spa or the like, said unit comprising:

a hollow unit body adapted to be mounted in the side of a pool, spa or the like said hollow unit body having a top, a bottom, a front, a back and a right side and a left side;

a throat portion at the front of said hollow unit through which water is directed outwardly from said hollow unit body, said throat portion adapted to extend slightly past the side of the pool, spa or the like and said throat portion having an upper edge and a lower edge;

a manifold portion into which water is introduced, said manifold portion being located near the back of the unit body, and said manifold portion adapted to be located behind the side of the pool, spa or the like; and at least one baffle extending substantially vertically over the majority of the distance between the top and the bottom of the hollow unit body, and said baffle extending between the right side and the left side of said body, and said baffle being positioned between the manifold portion and the throat portion and nearer the manifold portion.

2. The unit for producing a waterfall of claim 1 wherein the top is oriented at an angle of between about 10° and 45° with respect to the bottom of the unit.

3. The unit for producing a waterfall of claim 2 wherein said angle between the top and the bottom is about 15°.

4. The unit for producing a waterfall of claim 1 wherein said lower edge of said throat extends past the upper edge of said throat.

5. The unit for producing a waterfall of claim 4 wherein the lower edge of the throat is angled downwardly about 10° to 45° from the horizontal.

6. The unit for producing a waterfall of claim 5 wherein the angle is about 15°.

7. The unit for producing a waterfall of claim 1 further including a plurality of reinforcing ribs spanning the distance between the top and the bottom of said unit, said reinforcing ribs being positioned parallel to the direction of flow of water in the unit and extending the majority of the distance between the manifold portion and the throat portion.

8. The unit for producing a waterfall of claim 7 wherein each of said reinforcing ribs has a water flow passageway positioned adjacent the bottom of the unit near the manifold end of the reinforcing ribs.

9. The unit for producing a waterfall of claim 1 wherein said manifold portion is an enlarged box at the manifold end of the unit.

10. The unit for producing a waterfall of claim 1 wherein said water is introduced into the unit body at one side of the unit and the unit has at least three baffles alternately affixed to the top and bottom of the unit and spanning the distance between the two sides of the unit.

11. The unit for producing a waterfall of claim 10 wherein the top and bottom of the unit are generally rectangular, and the baffles are not parallel to one another, and the rearmost baffle is at an angle of about --° and forms an expanding water flow area as water flows away from the inlet in which water is introduced into the unit.

12. A unit for producing a waterfall at the edge of a swimming pool, spa or the like, said unit adapted to be mounted in the side of the pool, spa or the like and being capable of producing a smooth sheet of water which is directed away from the side of the pool, spa or the like, said unit comprising:

a hollow unit body adapted to be mounted in the side of a pool, spa or the like, said hollow unit body having a top, a bottom, a front, a back and a right side and a left side;

a throat portion at the front of said hollow unit through which water is directed outwardly from said hollow unit body, said throat portion adapted to extend slightly past the side of the pool, spa or the like, and said throat portion having an upper edge and a lower edge, and the lower edge extending outwardly past the upper edge, and said lower edge being angled downwardly with respect to the upper edge;

a manifold portion into which water is introduced, said manifold portion being located near the back of the unit body and said manifold portion adapted to be located behind the side of the pool, spa or the like;

at least one baffle extending the majority of the distance between the top and the bottom of the hollow unit body, and said baffle extending between the right side and the left side of said body, and said baffle being positioned between the manifold portion and the throat portion and nearer the manifold portion; and a plurality of reinforcing ribs spanning the distance between the top and the bottom of said unit, said reinforcing ribs being positioned parallel to the direction of flow of water in the unit and extending the majority of the distance between the manifold portion and the throat portion.

13. The unit for producing a waterfall of claim 12 wherein each of said reinforcing ribs has a water flow passageway positioned adjacent the bottom of the unit near the manifold end of the reinforcing ribs.

14. The unit for producing a waterfall of claim 12 wherein said baffle is affixed to the bottom of the unit and terminates near the top of the unit.

* * * * *